US005862668A

United States Patent [19]

Richardson

[11] Patent Number: 5,862,668

[45] Date of Patent: Jan. 26, 1999

[54] GAS TURBINE ENGINE COMBUSTION EQUIPMENT

[75] Inventor: John S Richardson, Nottingham, England

[73] Assignee: Rolls-Royce plc, London, England

[21] Appl. No.: 807,142

[22] Filed: Feb. 27, 1997

[30] Foreign Application Priority Data

Apr. 3, 1996 [GB] United Kingdom ..... 9607010

[51] Int. Cl.[6] ..... F23R 3/30; F23R 3/34

[52] U.S. Cl. ..... 60/737; 60/747

[58] Field of Search ..... 60/734, 737, 739, 60/746, 747

[56] References Cited

U.S. PATENT DOCUMENTS

| | | | |
|---|---|---|---|
| 4,344,280 | 8/1982 | Minakawa | 60/747 |
| 4,499,735 | 2/1985 | Moore et al. . | |
| 5,257,502 | 11/1993 | Napoli | 60/739 |
| 5,402,634 | 4/1995 | Marshall | 60/747 |
| 5,660,045 | 8/1997 | Ito | 60/739 |

*Primary Examiner*—Louis J. Casaregola

*Attorney, Agent, or Firm*—W. Warren Taltavull; Farkas & Manelli PLLC

[57] ABSTRACT

A double annular combustor for a gas turbine engine is provided with annular arrays of main and pilot fuel injection modules. The main fuel injection modules are of the premix type so as to vaporise fuel. However, the pilot fuel injection modules are configured so as to function as both premix and airspray fuel injectors. During starting and low power conditions, the pilot fuel injectors are operational alone in their airspray mode. However during high power conditions, both the main and pilot fuel injection modules function as premix injectors. The arrangement reduces noxious emissions.

13 Claims, 2 Drawing Sheets

GAS TURBINE ENGINE COMBUSTION EQUIPMENT

THE FIELD OF THE INVENTION

This invention relates to gas turbine engine combustion equipment and is particularly concerned with combustion equipment which produces reduced quantities of noxious emissions.

BACKGROUND OF THE INVENTION

The combustion equipment of a typical gas turbine engine is required to operate efficiently over a wide range of conditions while at the same time producing minimal quantities of noxious emissions, particularly those of the oxides of nitrogen. This, unfortunately, presents certain problems in the design of suitable fuel injection devices for use as part of the combustion equipment. Thus the characteristics of a given fuel injector under light-up and low speed conditions are different to those under full power conditions. Consequently a fuel injector is often a compromise between two designs to enable it to operate under both of these conditions. This can result in combustion equipment which produces undesirably large amounts of the oxides of nitrogen, particularly when it is operating under one of these sets of conditions.

EP 0660038 describes one form of gas turbine engine fuel injector which is provided with two fuel supply ducts. Fuel is supplied through one supply duct under starting or low power conditions and through the other or through both fuel supply ducts under high power conditions. The fuel from both ducts is mixed with air in such a way that efficient, low emission combustion takes place under a wide range of engine operating conditions.

GB 2010408 describes a somewhat different approach to the reduction of noxious emissions in which a gas turbine engine annular combustion chamber of the type known as the double annular type is provided with two concentric annular arrays of fuel injectors. The radially inward array is of pilot fuel injectors whereas the radially outward array is of main fuel injectors. During light up and low speed conditions, only the pilot fuel injectors are used whereas both the pilot and the main fuel injectors are used under higher speed conditions. The pilot combustion stage is long in comparison with the main combustion stage. Consequently, the residence time in the pilot stage is comparatively long, thereby limiting the emissions of hydrocarbons and carbon monoxide. The residence time in the main stage is comparatively short, thereby limiting emissions of the oxides of nitrogen.

SUMMARY OF THE INVENTION

It is an object of the present invention to provide combustion equipment for a gas turbine engine having improved effectiveness in the reduction of noxious emissions.

According to the present invention, combustion equipment for a gas turbine engine comprises an annular combustion chamber defining primary and main combustion zones, an annular array of pilot fuel injection modules and an annular array of main fuel injection modules, said arrays of fuel injection modules being substantially evenly spaced about the central axis of the combustion chamber disposed within said combustion chamber, each of said main fuel injection modules being operationally supplied with liquid fuel and configured to vaporise that fuel and to exhaust it into said main combustion zone, first and second fuel supply passages being provided to operationally supply said pilot fuel injection modules with fuel, each of said pilot fuel injection modules being configured to vaporise fuel from it's first fuel supply passage prior to the exhaustion thereof into said primary combustion zone and to atomise fuel from it's second fuel supply passage prior to the exhaustion thereof into said primary combustion zone, said combustion equipment additionally including fuel distribution means to selectively direct fuel to said main fuel injection modules and said first fuel supply passages to said pilot fuel injection modules simultaneously, or alternatively to direct fuel to said second fuel supply passages to said pilot fuel injection modules only.

Under engine light-up and low power conditions, fuel is applied only to the second fuel supply passages. The pilot fuel injection modules atomise that fuel prior to exhausting it into the primary combustion zone which leads to good low power stability. Under high power conditions, fuel is supplied to both the pilot and main fuel injection modules and is vaporised by them. This brings about low emissions of the oxides of nitrogen combustion equipment in accordance with the present invention and therefore provides low power stability and the production of low amounts of the oxides of nitrogen and other undesirable combustion products at high power.

BRIEF DESCRIPTION OF THE DRAWINGS

The present invention will now be described, by way of example, with reference to the accompanying drawings in which.

DETAILED DESCRIPTION OF THE INVENTION

Figure 1:
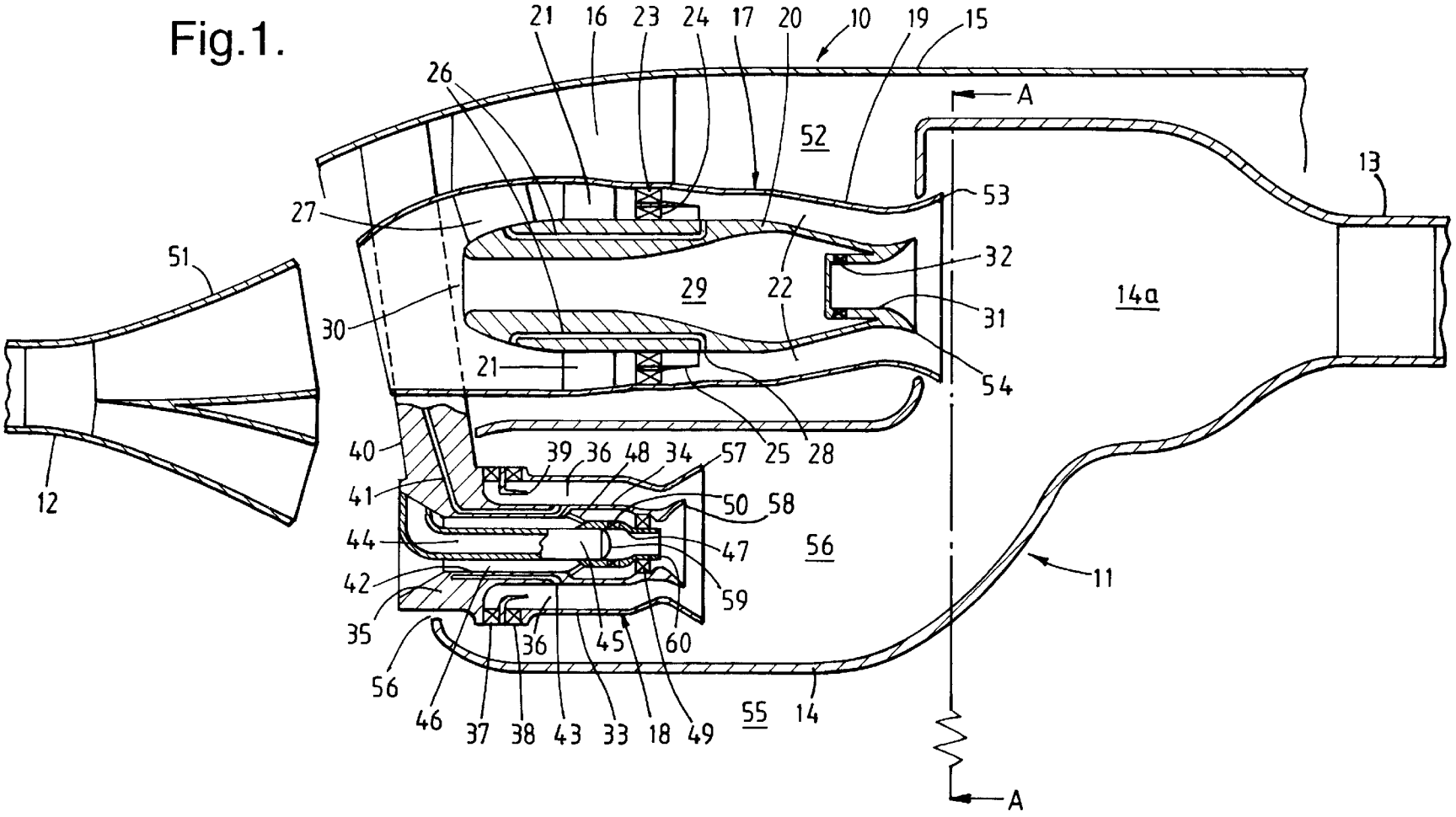
FIG. 1 is a sectioned side view of part of a gas turbine engine having combustion equipment in accordance with the present invention.

Referring to FIG. 1, a gas turbine engine, part of which can be seen at 10, includes combustion equipment 11 in accordance with the present invention. The combustion equipment 11 is positioned between the downstream end 12 of the engine's compression system and the upstream end 13 of it's turbine system. The combustion equipment 11 comprises an annular combustion chamber 14 that is attached at it's downstream end (with respect to the general direction of gas flow through the chamber 14) to the upstream end 13 of the turbine system. Additionally, the radially outer extent of the upstream end of the combustion chamber 14 is attached to part of the engine casing 15 by a plurality of radially extending struts 16.

Figure 2:
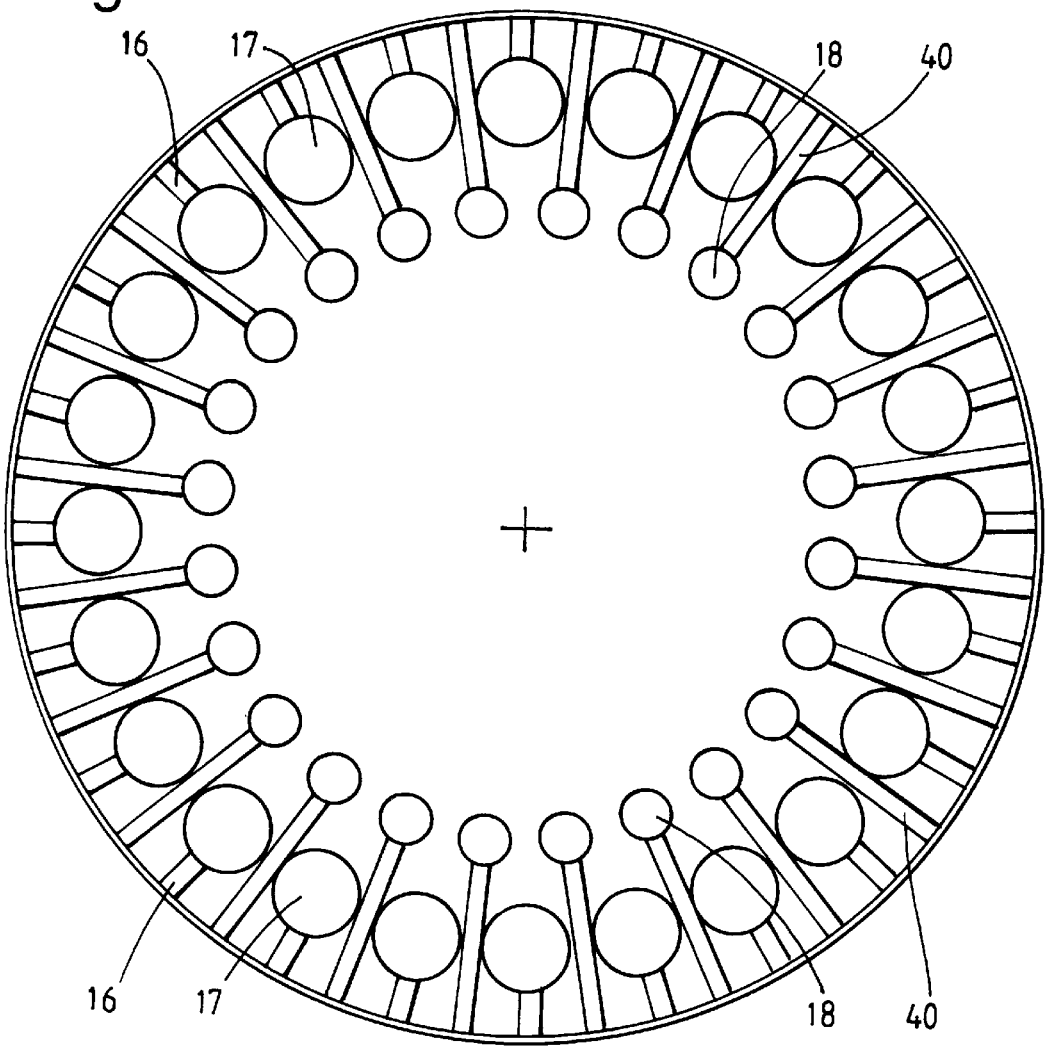
FIG. 2 is a view on section line A—A of FIG. 1.

The combustion chamber 14 is of the so-called double annular type. It encloses two concentric annular arrays of equally spaced apart main and pilot fuel injection modules 17 and 18 as can be seen in FIG. 2. The pilot fuel injection modules 18 are positioned radially inwardly of the main fuel injection modules 17 although it will be appreciated that this relationship could be reversed if so desired with the pilot fuel injection modules 18 being positioned radially outwardly of the main fuel injection modules 17. The array of radially inner pilot modules 18 is circumferentially offset from the array of radially outer main modules 17 as can also be seen in FIG. 2. However, this is not absolutely essential so that under certain circumstances, it may be desirable to radially align each inner pilot module 18 with a main module 17.

The radially outer main fuel injection modules 17 are all of the premix type. They are configured so as to substantially completely vaporise liquid fuel before directing that fuel into the main combustion zone 19 of the combustion chamber 14.

Each main fuel module 17 consists of an annular external casing 19 within which a centre body 20 is coaxially positioned. The centre body 20 is maintained in radially spaced apart relationship with the casing 19 by means of a number of radially extending support struts 21. An annular passage 22 is thereby defined between the centre body 20 and the casing 19. The passage 22 also contains two coaxial annular arrays of swirler vanes 23 and 24 which are positioned a short distance downstream of the support struts 21. The radially outer array of vanes 23 are so inclined as to swirl air passing over them in a clockwise direction whereas the radially inner array of vanes 24 are so inclined as to swirl air passing over them in an anti-clockwise direction. A short cowl 25 is interposed between and extends downstream of the vanes 23 and 24 to provide some degree of separation of the swirling air flows exhausted from them.

The centre body 20 contains a plurality of generally axially extending passages 26. The passages 26 are supplied at their upstream ends with liquid fuel through fuel supply arms 27 which pass through the struts 16. Each passage 26 terminates with an orifice 28 in the external surface of the centre body 19 downstream of the swirler vanes 23 and 24. Consequently fuel exhausted from the orifices 28 is directed in a radially outward direction across the annular passage 22.

The centre body 20 is hollow so as to define an interior 29, the upstream part of which is constant cross-sectional shape and the downstream part of which is of convergent/divergent shape. The upstream end 30 of the centre body 20 is open but it's downstream end is partially blocked by a divergent cup-shaped portion 31. An annular array of swirler vanes 32 provide a radial interconnection between the centre body interior and the interior of the cup-shaped portion 31.

The pilot fuel modules 18 are axially shorter than the main fuel modules 17 so that their downstream ends terminate upstream of the downstream ends of the main fuel injection modules 17. Each pilot fuel module 18 has an annular casing 33 within which a centre body 34 is coaxially positioned. A ring member 35 interconnects the upstream ends of the casing 33 and the centre body 34 so that an annular passage 36 is defined between the downstream parts thereof. Two annular arrays of radially directed swirler vanes 37 and 38 are provided in the wall of the casing 33 immediately downstream of the ring member 35. The upstream array of swirler vanes 37 are inclined so as to rotate air passing thereover in a clockwise direction whereas the downstream array 38 are inclined so as to rotate air passing thereover in an anti-clockwise direction. An L-shaped cross-section deflector 39 positioned between the arrays of swirler vanes 37 and 38 redirects any air flow exhausted from the vanes 37 and 38 from the radial to a generally axial direction through the passage 36.

Each pilot fuel module 18 is provided with two supplies of liquid fuel, both of which are directed through a radial arm 40 which supports the module 18 from the engine casing 15. The first supply of fuel is delivered through a first fuel supply passage 41 which directs the fuel into a plurality of axially extending passages 42 in the centre body 34. The axially extending passages 42 terminate in orifices 43 in the radially outer surface of the centre body 34 so as to direct radial jets of fuel into the annular passage 36.

The second supply of fuel is delivered through a second fuel supply passage 44 defined by a conduit 45 which terminates within the centre body 34. The centre body 34 is of annular cross-sectional configuration in order to accommodate the conduit 45. The interior of the centre body 34 is of greater diameter than that of the conduit 45 so that an annular passage 46 is defined between the centre body 34 and the conduit 45. The downstream end of the centre body 34 is provided with a support member 47 which serves to support the downstream end of the conduit 45. The support member 47 is of generally tubular form and is itself supported from the internal surface of the centre body 34 by a plurality of struts 48 at it's upstream end and by an annular array of swirler vanes 49 at it's downstream end. The support member 47 carries an annular array of swirler vanes 50 immediately downstream of the downstream end of the conduit 45 to provide a radially inward path for the flow of air from the annular passage 46 into the interior of the support member 47.

Operationally, compressed air exhausted from the downstream end 12 of the engine's compression system is divided by an annular flow divider 51 into two flows, both of which are directed towards the upstream end of the combustion chamber 14. The first flow has a radially outward component so that it is directed towards the upstream end of the main fuel injection modules 17. Some of the air flows through an annular gap 52 defined between the engine casing 15 and the radially outer extent of the combustion equipment 11. This airflow serves to provide cooling of the combustion equipment 11 and also dilution air for the combustion process taking place within the combustion chamber 14. The dilution air flows through small inlet holes (not shown) in the wall of the combustion chamber 14. The remainder of the air flows into the upstream ends of the main fuel injection modules 17.

Within each main fuel injection module 17, the air flow is divided with part flowing through the annular passage 22 between the centre body 20 and the casing 19, and the remainder flowing into the centre body interior 29 through it's upstream end 30. The air flowing into the centre body interior 29 flows over the swirler vanes 32 to provide a radially inward swirling flow of air into the divergent cup-shaped portion 31. That air flow then flows over the internal surface of the cup-shaped portion 31 to emerge as a swirling, divergent flow from the centre body portion 31 into the combustion chamber 14 interior.

The air flow through the annular passage 22 is divided into two opposite handed swirling flows by the two sets of swirler vanes 23 and 24, This creates a large degree of turbulence in the air flow which in turn provides very efficient mixing of the air with liquid fuel exhausted from the orifices 28. This mixing continues as the fuel and air flow along the annular passage 22 resulting eventually in the virtually complete vaporisation of the fuel.

The vaporised fuel and air are subsequently exhausted into the main combustion zone 14*a* of the combustion chamber 14 where combustion takes place. The downstream ends 53 and 54 of the main fuel module casing 19 and it's centre body 20 respectively are outwardly flared so as to provide an effective distribution of the vaporised fuel within the combustion zone 14*a*. The air emerging from the centre body cup-shaped portion 31 assists in this distribution process and ensures that there are appropriate proportions of fuel and air present for efficient combustion to take place.

The second flow of compressed air from the annular flow divider 51 has a radially inward component so that it is directed towards the upstream end of the pilot fuel injection manifolds 18. Some of the air flows through the region 55 radially inwards of the combustion equipment 11. As in the case of the air flow through the gap 52 around the radially outer extent of the combustion equipment, the air flow through the region 55 provides both cooling of the combustion equipment 11 and dilution air for the combustion process taking place within the combustion chamber 14.

A further portion of the air flows into the combustion chamber 14 through small gaps 56 provided between each pilot fuel injector 18 and the upstream wall of the combustion chamber 14. Some of that air then flows radially inwardly through the swirl vanes 37 and 38 in the pilot fuel injector casing 33 and into the annular passage 36 between the centre body 34 and the outer casing 33 of the pilot fuel injector 18. The swirl vanes 37 and 38 ensure that the air flow through the gap 36 is turbulent, thereby in turn providing efficient mixing of the air with liquid fuel exhausted from the orifices 43. As in the case of the main fuel injection module 17, this turbulent mixing, together with the subsequent flow through the passage 36, ensures that virtually all of the liquid fuel exhausted from the orifices 43 is vaporised.

The remainder of the air flows through the annular passage 46 between the centre body 34 and the conduit 45 to be swirled by the swirl vanes 49 before emerging from the downstream end of the centre body 34 into the primary combustion zone 56.

The vaporised fuel and air are finally exhausted into a primary combustion zone 56 within the radially inner region of the combustion chamber 14, where they are mixed with the swirling airflow emerging from the centre body 34. There, the mixture of fuel and air is combusted. As in the case of the main fuel injection module 17, the downstream ends 57 and 58 of the pilot fuel module casing 33 and it's centre body 34 respectively are outwardly flared so as to achieve an effective distribution of the vaporised fuel within the primary combustion zone 56.

As can be seen from FIG. 1, the primary combustion zone 56 is upstream and radially inward of the main combustion zone 14*a* so that there is a general flow of combustion products from the primary combustion zone 56 into the main combustion zone 14*a*.

It will be seen that when operating in the manner described above, both the main fuel injection module 17 and the pilot fuel injection modules 18 function as premix fuel injectors. Such injectors rely on substantially complete vaporisation of liquid fuel prior to the fuel being directed into the combustion zones. The resultant combustion process is very efficient with low emissions of noxious substances such as the oxides of nitrogen. While this is highly desirable, premix fuel injectors are not satisfactory during engine starting and low power operation. Under these conditions, it is very difficult to achieve complete fuel vaporisation and the limits within which combustion is sustainable are narrow. Consequently, the main and pilot fuel injection modules 17 and 18 are only used in the above described premix mode under engine cruise and high power conditions.

In order to overcome these difficulties during engine starting and low power operation, the fuel flow to the main fuel injector modules 24 is cut off, as is the fuel flow to the pilot fuel modules 18 through the fuel supply passage 41. The fuel supply to each pilot fuel module 18 is switched to being supplied through the second fuel supply passage 44 in the conduit 45 so that a divergent spray of liquid fuel is exhausted from a nozzle 59 positioned on the downstream end of the conduit 45. That fuel is partially atomised by the turbulent air flow exhausted from the swirler vanes 50 located in the conduit support member 47. The remainder of the fuel is deposited upon and then flows along the radially inner surface of the support member 47 before reaching it's downstream lip 60. There the fuel is launched from the lip 60 whereupon it is acted upon by both the air flow from the swirler vanes 50 and the air flow from the annular passage 46 after it has been swirled by the vanes 49. This results in substantially complete atomisation of the fuel before it is finally directed into the primary combustion zone 56 where combustion takes place.

In this mode of operation, the pilot fuel injection module 18 functions as a conventional airspray type of fuel injector. Such fuel injectors are not as efficient as premix type fuel injectors in reducing noxious emissions. However, they are stable over a wide operating range and function well during engine starting. They are thus very effective during engine starting and low power conditions.

If desired, the nozzle 59 could be of the pressure jet type which would inject fuel as a jet into the primary combustion zone 56. Such injectors are generally as equally effective as airspray fuel injectors during engine starting and low power conditions.

Figure 3:
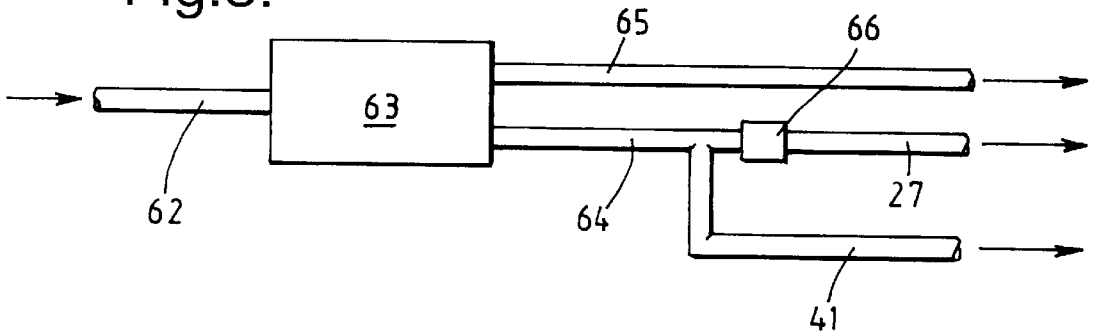
FIG. 3 is a diagrammatic view of part of the fuel distribution system of the combustion equipment in accordance with the present invention.

In order to facilitate the transition between the two modes of combustor operation described above, the fuel distribution system shown schematically at 61 in FIG. 3 is utilised. The fuel distribution system 61 constitutes part of the combustion equipment 10. It comprises a fuel inlet duct 62 which directs liquid fuel into a fuel distributor 63. The fuel distributor 63 is controlled by the electronic control system which in turn controls the overall supply of fuel to the combustion equipment 10. Such control systems are well known in the art and will not therefore be described.

The fuel distributor 63 directs fuel from the inlet duct 62 to one of two types of outlet ducts 64 and 65, only one of each of which are shown in FIG. 3. The first outlet ducts 64 are bifurcated to direct fuel to the fuel supply arms 27 to the main fuel injection modules 17 and the first fuel supply passages 41 to the pilot fuel injection modules 18. Spring loaded valves 66 are positioned in the fuel supply arms 27 to ensure that under low fuel flow conditions, fuel flows preferentially into the first fuel supply passages 41 and under high fuel flow conditions, fuel flows into both passages 27 and 41. The second outlet ducts 65 supply fuel directly to the second fuel supply passages 44 to the pilot fuel injection modules 18.

During engine starting, the fuel distributor 63 is set to direct fuel only through the second outlet ducts 65. That fuel then flows through the second fuel supply passages 44 to be subsequently directed from the fuel nozzles 59 in the pilot fuel injection modules 18 into the primary combustion zone 56 of the combustion chamber 14. There the fuel is ignited by a conventional electrical igniter (not shown). The resultant combustion products then flow through the main combustion zone 14*a* before exhausting into the upstream end 13 of the engine's turbine. This mode of combustion is operated during both engine idle and low power operation in which it combines good combustion efficiency with operational stability.

When more power is required, the fuel distributor 63 is actuated to cause it to redirect fuel from it's inlet duct 62 to it's first outlet ducts 64. This causes a smooth transition from the supply of fuel to the first outlet ducts 65 to the supply of fuel to the second outlet ducts 64. The fuel flow through the fuel supply duct 62 is then progressively increased. Initially, the presence of the valves 66 in the passages 27 ensures that the fuel flows only into the first fuel supply passages 41. The pilot fuel injection modules 18 thus change their mode of operation from one of fuel atomisation to one of fuel vaporisation. This has the immediate effect of reducing noxious emissions from the combustion equipment 10. When the primary combustion zone 56 has achieved an optimum stoichiometry and the fuel flow is increased still further to the levels necessary to provide sufficient power for gas turbine engine cruise conditions, the valve 66 opens against it's spring pressure to permit fuel to flow additionally into the fuel supply arms 27. This results in the supply of fuel to the main fuel injection modules 17. The main fuel injection modules 17 vaporise that fuel as described earlier and direct it into the main combustion zone 14*a*. There the vaporised fuel encounters the hot combustion products exhausted from the pilot fuel injection modules 18 and is ignited thereby. The combined combustion products from both the main and pilot fuel injection modules 17 and 18 are then exhausted into turbine upstream end 13.

It will be seen therefore that under cruise and other high power modes of engine operation, both of the main and pilot fuel injection modules 17 and 18 function as premix type fuel injectors providing low emissions of the oxides of nitrogen. However, this is not at the expense of poor low power performance and stability since this is when the pilot fuel injection modules 18 operate as airspray fuel injectors. Combustion equipment 10 in accordance with the present invention therefore provides both low power stability and the production of low amounts of the oxides of nitrogen and other undesirable combustion products at high power.

I claims:

1. Combustion equipment for a gas turbine engine comprising an at least double annular combustion chamber and defining distinct primary and main combustion zones, an annular array of pilot fuel injection modules and an annular array of main fuel injection modules, said arrays of fuel injection modules being disposed substantially evenly spaced about a central axis, each of said main fuel injection modules being operationally supplied with air and liquid fuel and and having mixing passages to receive and vaporize that fuel and to exhaust it into said main combustion zone, first and second fuel supply passages being provided to operationally supply said pilot fuel injection modules with fuel, each of said pilot fuel injection modules being supplied with air to vaporize fuel from it's first fuel supply passage prior to the exhaustion thereof into said primary combustion zone and to atomize fuel from it's second fuel supply passage prior to the exhaustion thereof into said primary combustion zone, said combustion equipment additionally including fuel distribution means to selectively direct fuel to said main fuel injection modules and said first fuel supply passages to said pilot fuel injection modules simultaneously, and alternatively to direct fuel to said second fuel supply passages to said pilot fuel injection modules only.

2. Combustion equipment for a gas turbine engine as claimed in claim 1 wherein each of said main fuel injection modules and said pilot fuel injection modules defines an annular passage for the vaporisation of liquid fuel supplied thereto, each of said passages being operationally supplied with liquid fuel and with said air therethrough to vaporise said fuel.

3. Combustion equipment for a gas turbine engine as claimed in claim 2 wherein each of said passages is provided with swirler vanes to swirl air flow therethrough prior to the vaporisation of said fuel by said air.

4. Combustion equipment for a gas turbine engine as claimed in claim 2 or claim 3 wherein each of said pilot fuel modules additionally includes a fuel injection nozzle to atomise said fuel supplied thereto through said second fuel supply passage.

5. Combustion equipment for a gas turbine engine as claimed in claim 4 wherein said fuel injection nozzle is located radially inwardly of said annular passage.

6. Combustion equipment for a gas turbine engine as claimed in claim 5 wherein said fuel injection nozzle is of the airspray type.

7. Combustion equipment for a gas turbine engine as claimed in claim 1 wherein flow limiting means are provided to inhibit the supply of fuel to said main fuel injection modules unless the supply of fuel through said first supply passages to said pilot fuel injection modules is greater than a predetermined value.

8. Combustion equipment for a gas turbine engine as claimed in claim 7 wherein said flow limiting means comprises a spring loaded valve.

9. Combustion equipment for a gas turbine engine as claimed in claim 1 wherein said primary and main combustion zones are so positioned that the combustion products from said primary zone flow through said main zone prior to the exhaustion thereof from said combustion chamber.

10. Combustion equipment for a gas turbine engine as claimed in claim 1 wherein said main fuel injection modules are positioned radially outwardly of said pilot fuel injection modules.

11. Combustion equipment for a gas turbine engine as claimed in claim 1 wherein said main fuel injection modules are circumferentially offset from said pilot fuel injection modules.

12. Combustion equipment for a gas turbine engine as claimed in claim 1 wherein the outlets of said main fuel injection modules are axially offset from the outlets of said pilot fuel injection modules.

13. Combustion equipment for a gas turbine engine comprising an at least double annular combustion chamber having a central axis and defining distinct primary and main combustion zones, an annular array of pilot fuel injection modules and an annular array of main fuel injection modules, said arrays of fuel injection modules being disposed substantially evenly spaced about said central axis within said combustion chamber, each of the pilot fuel modules having a central axis and a downstream end, and each of said main fuel modules having a central axis and a downstream end, the central axes of the pilot fuel modules being radially disposed with respect to the central axes of the main fuel modules, the downstream ends of the pilot modules terminating upstream of the downstream ends of the main fuel modules, and the primary combustion zone disposed radially and axially from the main combustion zone; each of said main fuel injection modules being operationally supplied with air and liquid fuel and having mixing passages to receive and vaporize that fuel and to exhaust it into said main combustion zone, first and second fuel supply passages being provided to operationally supply said pilot fuel injection modules with fuel, each of said pilot fuel injection modules being supplied with air to vaporize fuel from it's first fuel supply passage prior to the exhaustion thereof into said primary combustion zone and to atomize fuel from it's second fuel supply passage prior to the exhaustion thereof into said primary combustion zone, said combustion equipment additionally including fuel distribution means to selectively direct fuel to said main fuel injection modules and said first fuel supply passages to said pilot fuel injection modules simultaneously, and alternatively to direct fuel to said second fuel supply passages to said pilot fuel injection modules only.

* * * * *